US005978749A

United States Patent [19]

Likins, Jr. et al.

[11] Patent Number: 5,978,749

[45] Date of Patent: Nov. 2, 1999

[54] PILE INSTALLATION RECORDING SYSTEM

[75] Inventors: Garland E. Likins, Jr., Newbury; Frank Rausche, Chagrin Falls, both of Ohio; George Goble; Ned Shafer, both of Boulder, Colo.

[73] Assignee: Pile Dynamics, Inc., Cleveland, Ohio

[21] Appl. No.: 08/884,990

[22] Filed: Jun. 30, 1997

[51] Int. Cl.[6] ..... E02D 13/00

[52] U.S. Cl. ..... 702/158; 73/11.03; 364/468.15

[58] Field of Search ..... 702/158, 6, 166, 702/182, 188; 364/146, 468.15; 73/11.03; 405/227, 228, 231, 232, 285; 52/170

[56] References Cited

U.S. PATENT DOCUMENTS

| | | | |
|---|---|---|---|
| 4,271,475 | 6/1981 | Sahajdak | 364/506 |
| 4,277,676 | 7/1981 | Kammerer | 235/92 |
| 4,365,306 | 12/1982 | House et al. | 364/551 |
| 4,394,577 | 7/1983 | Peterson et al. | 250/372 |
| 4,461,015 | 7/1984 | Kulhavy | 377/24 |
| 4,538,248 | 8/1985 | Lenhardt | 367/25 |
| 4,722,603 | 2/1988 | Graebner et al. | 356/345 |
| 4,862,424 | 8/1989 | Graebner et al. | 367/33 |
| 4,924,596 | 5/1990 | Vachon | 33/715 |
| 5,303,162 | 4/1994 | Yoon | 364/550 |
| 5,345,471 | 9/1994 | McEwan . | |
| 5,361,070 | 11/1994 | McEwan . | |
| 5,448,914 | 9/1995 | Van Middelorp | 73/432.1 |
| 5,457,394 | 10/1995 | McEwan . | |
| 5,465,094 | 11/1995 | McEwan . | |
| 5,510,800 | 4/1996 | McEwan . | |
| 5,512,834 | 4/1996 | McEwan . | |
| 5,517,198 | 5/1996 | McEwan . | |
| 5,519,400 | 5/1996 | McEwan . | |
| 5,521,600 | 5/1996 | McEwan . | |
| 5,523,760 | 6/1996 | McEwan . | |
| 5,548,397 | 8/1996 | Kool et al. | 356/141.1 |
| 5,581,013 | 12/1996 | Frederick | 73/11.03 |
| 5,610,818 | 3/1997 | Ackroyd et al. | 364/424.07 |

FOREIGN PATENT DOCUMENTS

| | | | |
|---|---|---|---|
| 295 09 391 U1 | 8/1995 | Germany . | |
| PCT/DK94/00491 | 12/1994 | WIPO | E02D 1/00 |

OTHER PUBLICATIONS

Internet Web Page at http://www.pile.com/Newproducts/pir–dp.htm, unknown.

Internet Web page at http://www.pile.com/Newproducts/pir–cfa.htm, unknown.

Internet web Page at http://www.pile/com/Newproducts/product_intro.html#PDA, unknown.

Jean Lutz S.A., Brochure on Taracord (date unknown).

Pile Dynamics, Inc. and Goble & Associates, Inc., Brochure on Check Hammer Performance with the Saximeter—Stroke Indicator and Blow Count Logger (date unknown).

IFCO Brochure on the IFCO IM–System (date unknown).

Pile Dynamics, Inc., Brochure on Memory Saximeter—Economical Portable Unit For Better Control Of Pile Driving, copyright 1990.

Pile Dynamics, Inc., Brochure on The Pile Driving Controller PDC—A new tool in pile driving quality control (date unknown).

U.S. Federal Highway Administration (FHWA), *Proceedings*, International Conference on Design and Construction of Deep Foundations, Dec. 1994.

*Primary Examiner*—Patrick Assouad

*Attorney, Agent, or Firm*—Arter & Hadden LLP

[57] ABSTRACT

A pile installation recording system for driven piles and auger cast piles. The recording system records a variety of parameter data received from sensing devices. The parameter data is stored, analyzed, and displayed to provide the operator with accurate and timely information regarding the pile installation. In addition, the parameter data may be stored on removable media, and further manipulated to generate a variety of reports regarding the pile installation.

32 Claims, 10 Drawing Sheets

| DEPTH | COMMENTS |
|---|---|
| 0.0M | PITCH 12.1M PILE |
| 0.0M | MONITOR WITH PDA |
| 12.0M | STOP 05:40 TO 05:58 |
| 12.0M | PITCH NEXT 12.2M PILE |
| 12.0M | RELOCATE PDA GAUGES |
| 23.0M | STOP 06:05 TO 06:10 |
| 23.0M | PITCH NEXT 12.2M PILE |
| 23.0M | RELOCATE PDA GAUGES |
| 36.0M | STOP 06:25 TO 06:30 |
| 36.0M | PITCH NEXT 6.1M PILE |
| 36.0M | RELOCATE PDA GAUGES |

AUGERING SCREEN

GROUTING PHASE SCREEN

BON-3

PILE DATA SUMMARY

| AUGER DIAMETER | PUMP VOLUME | FLOW METHOD |
|---|---|---|
| 14 INCHES | 0.60 | MAGNETIC FLOW METER |

| PROJECT NAME | PILE NAME |
|---|---|
| | BON-3 |

| OPERATOR | ADDITIONAL INFORMATION |
|---|---|
| NED | NONE |

| THEORETICAL PILE VOLUME | ACTUAL PILE VOLUME |
|---|---|
| 36.3 CUBIC FEET | 53.3 CUBIC FEET |

| PILE LENGTH | AVERAGE DIAMETER |
|---|---|
| 33.99 FEET | 16.9 INCHES |

TEST 1.1

PILE INSTALLATION RECORDING SYSTEM

FIELD OF THE INVENTION

The present invention relates generally to a data recording system, and more particularly to a pile installation recording system for monitoring the installation of driven and auger cast piles.

BACKGROUND OF THE INVENTION

Present construction techniques include foundations formed from deep routed support columns referred to as piles. Current pile technology falls into two basic types: (1) driven piles, which are pounded into the earth by a series of blows from an automated hammer; and (2) auger cast piles, which are formed by drilling into the earth with an auger and backfilling the resulting hole with concrete as the auger is withdrawn. It should be noted that driven piles are typically made of steel, timber, or concrete.

Larger equipment and higher design loads are often specified to minimize the number of piles and reduce project costs. Therefore, performance of each foundation element is more critical, requiring additional quality assurance for every element of a project. It is easily recognized that quality is involved in the success or failure of any project. Since projects built on deep foundations require that a support system be properly installed, failure of any component could result in the failure of the entire project regardless of how carefully the above ground structure is built. Individual inspection of driven or cast-in-situ piles is practically impossible after installation, and thus quality control during pile installation is of great importance. Accordingly, most construction codes specify proper recording of installation observations. Many companies require total quality management (TQM) for risk management to reduce legal liability.

In the past, manual visual observations of blow count or drilling progress, followed by static testing of a small sample of piles, were often the only available construction quality control methods. There are numerous drawbacks to a manual recording system. In this respect, manually recorded observations are only as reliable as the observer, and thus numerous errors were common. For instance, counting blows during pile driving is monotonous, and lack of concentration or interference with the inspector caused inadvertent errors in counting.

The accuracy of both blow count and/or pile penetration was frequently very poor when reference marks were inaccurately drawn on the pile. The blow count for pile driving was often recorded for relatively large increments (i.e., blows per 250 millimeters, or blows per foot), and the pile was driven farther than necessary to assure consistent blow count. If the equivalent blow count over a smaller interval (or several successive smaller intervals to assess consistency), could be reliably taken, then the accuracy and economy of the project could both be significantly improved.

Furthermore, the field records were often transcribed for legibility, potentially compounding errors, particularly when the original field records were difficult to read. In addition, the recorded data was subject to abuse by alterations. Moreover, manual recording is a labor intensive process, and therefore expensive.

Static loading tests are performed on a small number of piles to at least twice the design load in order to prove the foundation design. Because of the high cost of failure, test piles are often purposefully driven harder or farther than necessary. As a result, proof tests usually pass easily, with the actual safety factors being higher than required. Production piles then use the same very conservative criteria, resulting in higher than necessary costs. In numerous cases the static tests are avoided due to high costs, unwanted construction delays, or because they are practically impossible for piles in deep water. While extra care is generally given in driving a test pile, production piles are often installed with less care, and thus may not achieve the same quality.

Current manual inspection reports often provide incomplete information and/or contain errors due to fast hammer speed, high number of blows and the monotonous nature of the task. Since errors are unacceptable, it is desirable to record the installation both automatically and accurately. Moreover, other important observations often neglected include actual hammer performance, pile inclination angle, start-interruption and/or end of driving times, pile cushion change, section length, and the like. Accordingly, there is a need for a pile installation recording system for driven piles, which automatically and accurately acquires data, and which provides accurate and comprehensive installation reports.

In the case of auger cast piles, there has been a reluctance to increase loads due to cross section uncertainties. In this respect, auger cast pile quality is very dependent upon the skill of the installation crew. If the continuous flight auger (CFA) is withdrawn too rapidly, the concrete volume will be reduced and the structural strength of the shaft may be insufficient. For auger cast piles, manual inspection is extremely difficult and therefore either minimal or even totally lacking. Determination of concrete volume can be perhaps made by counting cycles of the grout pump and calibrating the volume of each cycle. Even if this is accomplished the task must be coordinated with the auger withdrawal rate and this complexity means it is an almost impossible task to determine with any reasonable accuracy the volume pumped per unit depth. The shaft quality is totally dependent upon the skill of the contractor. The volume precision is insufficient for smaller diameter shafts. The "counting" is easily abused and the resulting manual inspection is usually at best a wild guess and not considered reliable by the engineer responsible for the project. In many cases, high safety factors are assigned to reduce this risk, making auger cast piles uneconomic. Accordingly, there is a need for a pile installation recording system for auger cast piles, which automatically and accurately acquires data for every auger cast pile during installation, and which provides accurate and comprehensive installation reports. This will increase the specifying engineer's confidence in the integrity of auger cast piles. As a result, auger cast piles will be more cost effective and more widely accepted at various project sites.

The present invention addresses the drawbacks of prior art manual recording methods, and provides significant improvements to existing electronic pile installation recording systems.

SUMMARY OF THE INVENTION

According to the present invention there is provided a pile installation recording system for controlling the installation of both driven piles and auger cast piles. The system includes a plurality of sensing devices for providing data to a control unit. The data may be displayed, stored or analyzed.

It is an advantage of the present invention to provide a pile installation recording system which saves time, reduces costs, and speeds construction by objectively and impartially monitoring pile installation and recording data.

It is another advantage of the present invention to provide a pile installation recording system having a simple, user-friendly and intuitively obvious user interface.

It is another advantage of the present invention to provide a pile installation recording system which provides precise measurements of working time, blow count, hammer performance and depth for driven piles.

It is another advantage of the present invention to provide a pile installation recording system which records actual hammer performance, pile inclination angle, start interruption and/or end of driving time, pile cushion change, section lengths, and the like for driven piles.

It is another advantage of the present invention to provide a pile installation recording system having improved accuracy.

It is another advantage of the present invention to provide a pile installation recording system which automatically generates installation reports suitable for assessing the quality of each pile installation.

It is another advantage of the present invention to provide a pile installation recording system having a detachable memory storage device for remote processing of collected data.

It is still another advantage of the present invention to provide a pile installation recording system, wherein the information required to be input into the system by the rig operator is minimized.

It is still another advantage of the present invention to provide a pile installation recording system which eliminates the need for an inspector to conduct blow counting.

It is still another advantage of the present invention to provide a pile installation recording system which allows lower safety factors to be considered.

It is still another advantage of the present invention to provide a pile installation recording system which records appropriate data, thus avoiding disputes regarding pile installation.

It is yet another advantage of the present invention to provide a pile installation recording system which generates summary sheets for each pile to improve productivity analysis.

It is yet another advantage of the present invention to provide a pile installation recording system which provides installation guidance by generating volume pumped data for auger cast piles.

It is yet another advantage of the present invention to provide a pile installation recording system which provides precise measurement of time, volume and pressure as a function of depth for auger cast piles.

It is yet another advantage of the present invention to provide a pile installation recording system which allows for immediate correction of errors while an auger cast shaft is still fluid.

These and other objects will become apparent from the following description of preferred embodiments taken together with the accompanying drawings and the appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
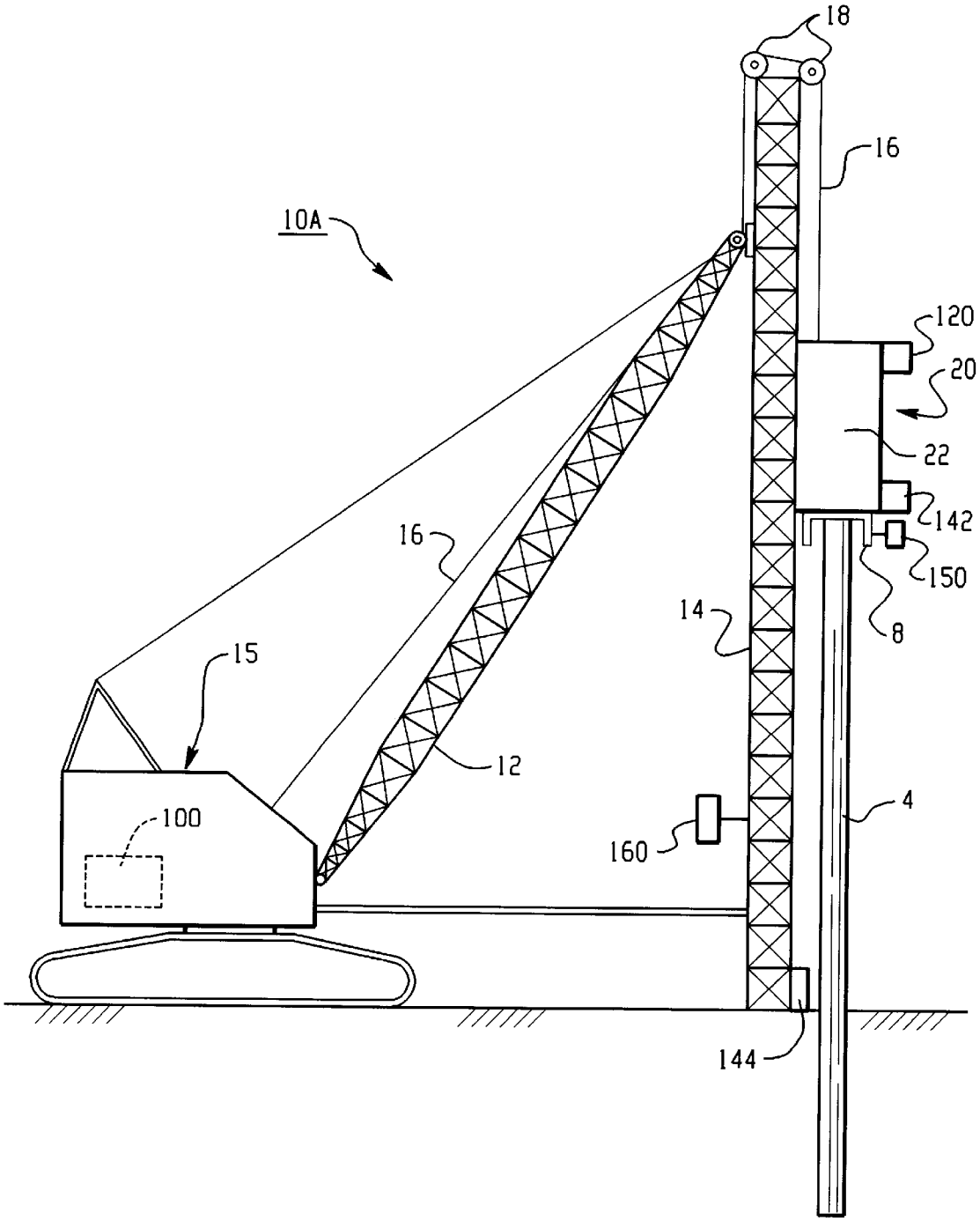
FIG. 1 is a perspective view of a pile driving rig for driven piles equipped with a pile installation recording system according to a preferred embodiment of the present invention.

Referring now to the drawings wherein the showings are for the purposes of illustrating a preferred embodiment of the invention only and not for purposes of limiting same, FIG. 1 shows a pile driving rig 10A for driven piles. Pile driving rig 10A is adapted for hammering piles 4 into the ground. Pile driving rig 10A is generally comprised of a boom 12, leads 14, a cab 15, cables 16, pulleys 18, and a hammer assembly 20. Boom 12 extends outward from cab 15 to support leads 14. Cable 16 extends from cab 15, across pulleys 18 to hammer assembly 20. Cable 16 supports an air/steam, diesel, or hydraulic driven hammer assembly 20. A ram 22 is associated with hammer assembly 20 for impacting pile 4.

Figure 2A:
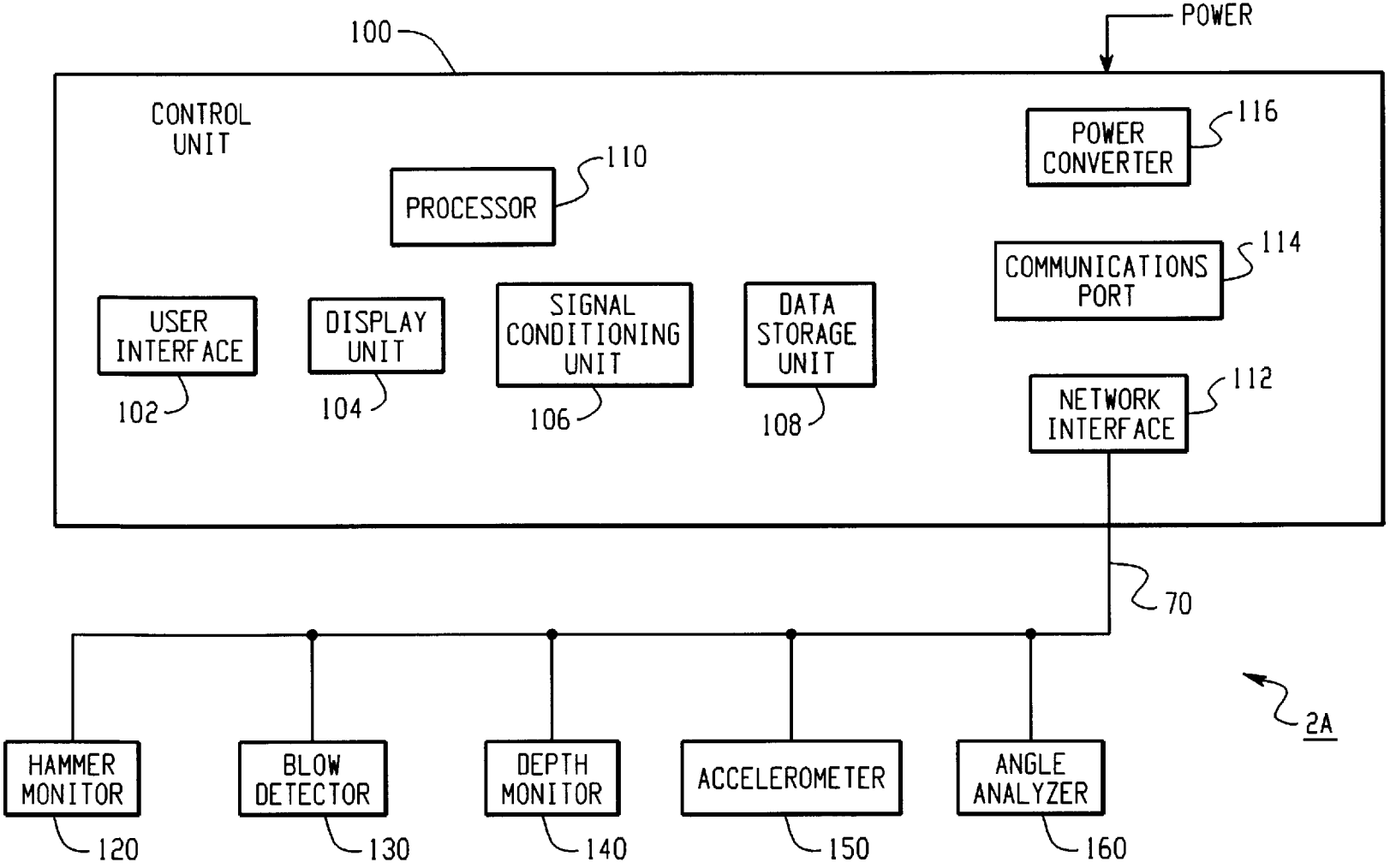
FIG. 2A is a block diagram of a pile installation recording system as configured for monitoring the installation of driven piles.

Referring now to FIG. 2A, there is shown a pile installation recording system 2A configured for monitoring installation of driven piles. Pile installation recording system 2A is generally comprised of a control unit 100 and sensing devices including a hammer monitor 120, a blow detector 130, a depth monitor 140, an accelerometer 150, and an angle analyzer 160.

Control unit 100 is preferably located inside cab 15 and receives data from the associated sensing devices mounted at appropriate locations on rig 10A, as seen in FIG. 1. However, it should be appreciated that control unit 100 could be suitably located external to cab 15. A detailed description of each sensing device will be provided below. Control unit 100 is generally comprised of a processor 110, a user interface 102, a display unit 104, a signal conditioning unit 106, and a data storage unit 108. Processor 110 processes the data received from the sensing devices and provides overall control of control unit 100. User interface 102 allows the user to input data to control unit 100, while display unit 104 displays both input and processed information to the operator.

It should be appreciated that user interface 102 may take the form of a keypad, a touch screen or the like. In a preferred embodiment of the present invention, user interface 102 takes the form of a touch screen; accordingly, user interface 102 and display unit 104 are combined to provide a suitable touch screen display unit. It should be understood that the user interface is user-friendly to minimize the required skill level of the operator. In this respect, onscreen menus are provided to intuitively guide the operator. The type of information input by the operator may include a pile name, a pile start depth, a pile end depth, and other appropriate information.

Signal conditioning unit 106 conditions the data sent from the sensing devices to recording system 2A. Data storage unit 108 provides means for storing data, which may be reviewed or processed at a later time. The data may include blow rate, depth, hammer energy, angle of installation, date, start/stop times, pile temporary compression, and the like. In a preferred embodiment data storage unit 108 is a removable flashcard memory device conforming to the PCMCIA standard, and having a storage capacity of at least 1.8 MB. Therefore, data storage unit 108 may be transferrable to a standard personal computer. In a preferred embodiment of the present invention, control unit 100 is powered by a 9 to 36 Volt D.C. power supply located inside cab 15. For instance, the power may be taken from the rigs electrical system (e.g., 12V or 24V DC). A power converter 116 converts the D.C. voltage to A.C. A portable battery power supply is provided where control unit 100 is used outside of cab 15. Control unit 100 also includes a network interface 112 and a communications port 114. Network interface 112 preferably takes the form of an RS485 serial interface, and is provided for transferring data via a communications network 70, which is described in detail below. Communications port 114 provides parallel and/or serial ports for directly connecting peripheral devices to control unit 100. For instance, a printer can be directly connected to control unit 100 to print reports in the field. Control unit 100 preferably has compact dimensions (e.g., 20mm×14mm×5mm) to conserve space inside cab 15 and provide portability.

Figure 2B:
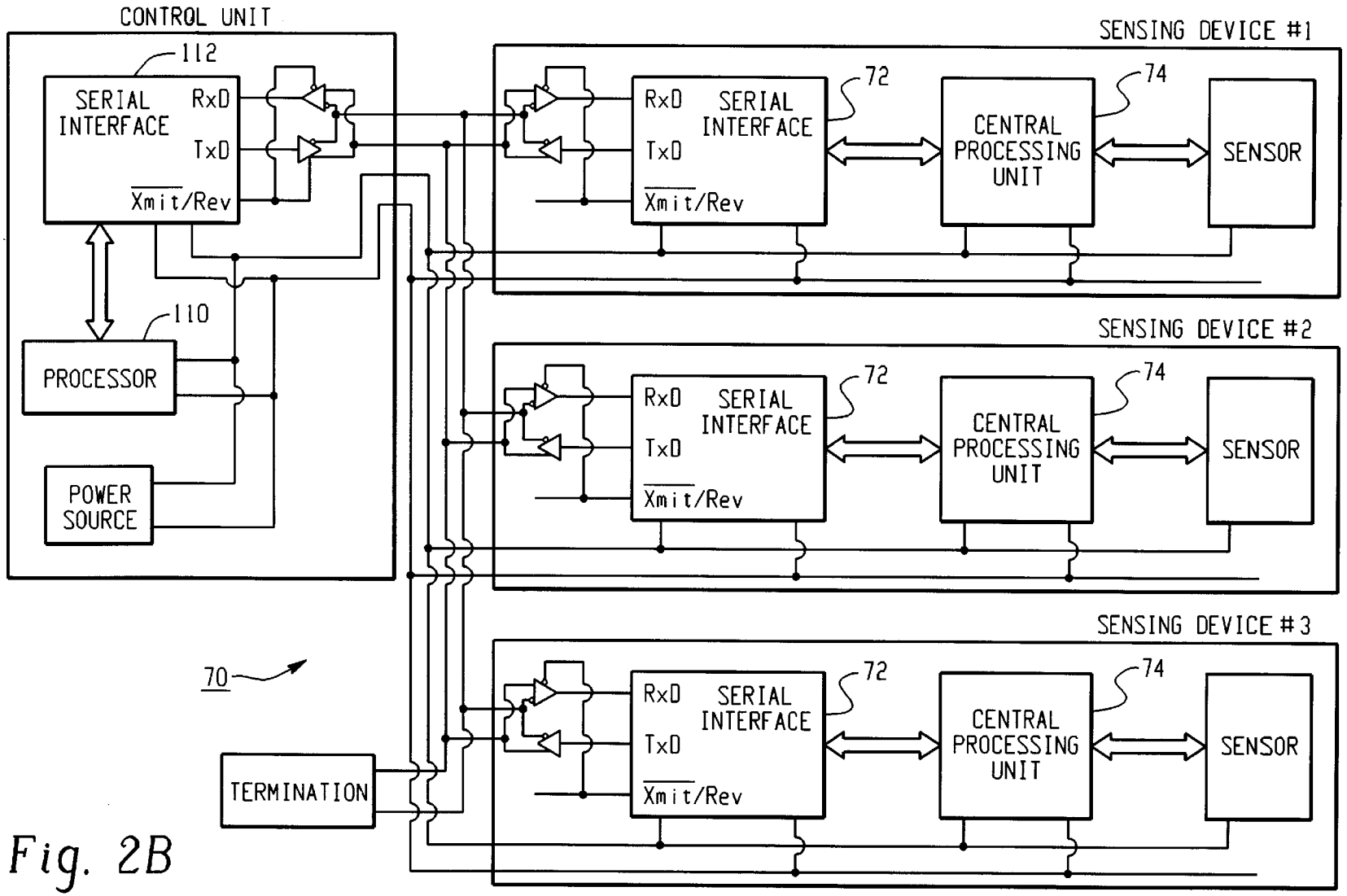
FIG. 2B is a schematic diagram of the network configuration for the pile installation recording system.

Communications network 70 will now be described with reference to FIG. 2B. Communications network 70 is preferably an RS485 network. The RS485 network includes high speed RS485 serial interfaces that allows data transmission up to 4 megabits a second over a "twisted pair." Communications network 70 allows multiple devices to be connected together, wherein one device is a master device and the remaining devices are slave devices. In the preferred embodiment of the present invention, control unit 100 is the master device, while the sensing devices are the slave devices. In a typical communication between devices on the network, the master device will send out the address identifying a slave device followed by a command. The master device then changes from a talk mode to a listen mode and waits for a response from the slave device. The slave device recognizes its address and then processes the command by changing its internal state and/or sending back the requested data. Once the master device receives the data it returns to a transmit mode. It should be appreciated that communication schemes for multiple node networks are more complex, and allow for slave devices to initiate communications. However, this requires additional hardware and software.

Some serial interface chips are designed to support a multiple node network and incorporate an address bit in any data sent on the serial network. The serial interface in the slave device can be programmed to ignore all transmissions until the address bit is set. Upon receiving a transmission with the address bit set the slave device wakes up and compares the transmitted address to its address. If they match it, the slave devices processes the data. If they do not match, it goes back to sleep and waits for the next address bit.

Sensing devices connected to communications network 70 include a serial interface 72, and a processing means (CPU 74) for computing resulting data. Each packet of data transferred on communications network 70 can include an identification of the device sending data, as well as the data itself It should be noted that one important advantage of communications network 70 is that it allows for convenient expansion of the sensing devices connected to control unit 100 to provide additional measurements. Another advantage of communications network 70 is that it allows for the elimination of numerous long data cables extending from each sensing device to control unit 100. In this respect, the data cables are susceptible to damage from being run over by heavy machinery.

In order to greatly reduce or eliminate the need for cables between the control unit and the sensing devices, a wireless communications interface may be provided. For instance, wireless modems may be used to communicate data between control unit 100 and the sensing devices. Preferably, the wireless modems are configured to support an network similar to an RS485 network. In this respect, a wireless modem connected to control unit 100 acts as the master, while the wireless modems connected to the sensing devices act as the slaves. It should be appreciated that each sensing device does not require its own wireless modem. Instead, a single wireless modem may be used for a group of sensing devices. It should also be noted that additional analog-to-digital converters may be required to convert the signal from the sensing device into digital data prior to transfer to the wireless modem.

It should be appreciated that some of the sensing devices may be directly connected to control unit 100, where continuous or immediate communication is required.

The sensing devices will now be described in detail with reference to FIG. 1. Hammer monitor 120 is preferably mounted to hammer assembly 20 and comprised of two proximity switches attached to hammer assembly 20 for monitoring the velocity of ram 22 just prior to impact with pile 4, and for calculating ram kinetic energy. In a case where hammer assembly 20 is already equipped with a sensing device for monitoring ram impact velocity and calculating ram kinetic energy, hammer monitor 120 can monitor output signals generated by hammer assembly 20.

Blow detector 130 detects blows and determines a hammer blow rate. The hammer blow rate can be used to calculate the stroke of ram 22 in the case where ram 22 is driven by a single acting diesel hammer. Blow detector 130 is suitably a stand-alone device, or a part of hammer monitor 120. Where blow detector 130 is a part of hammer monitor 120, it detects a blow when hammer monitor 120 detects a blow. In the case where blow detector 130 is a stand-alone device, it detects a hammer blow either by sensing sounds or vibrations, or by monitoring accelerometer 150 for a shock input. Accelerometer 150 is described in detail below. It should be noted that blow detector 130 may sense vibrations at any location on rig 10A, or alternatively sense ground vibrations.

Depth monitor 140 determines the depth at which pile 4 has been driven into the ground. Depth monitor 140 may take many forms including a micro impulse radar (MIR) transmitter and receiver system. For instance, depth monitor 140 may take the form of the MIR transmitter/receiver system disclosed in U.S. Pat. Nos. 5,345,471; 5,361,070; 5,523,760; 5,457,394; 5,465,094; 5,512,834; 5,521,600; 5,510,800; 5,519,400; and 5,517,198, which are incorporated herein by reference. A transmitter unit 142 is located on hammer assembly 20 and a receiver unit 144 is located at the base of leads 14 (FIG. 1). However, it should be appreciated that receiver unit 144 could alternatively be located at the top of leads 14. This may be a preferred location since receiver unit 144 is out of the way and has fewer obstructions which may interfere with proper reception.

It should be noted that receiver unit 144 may include filtering circuitry to minimize or eliminate any interference from other transmissions in the area (e.g., cellular phone transmissions). The filtering circuitry is well known to those skilled in the art.

Figure 3:
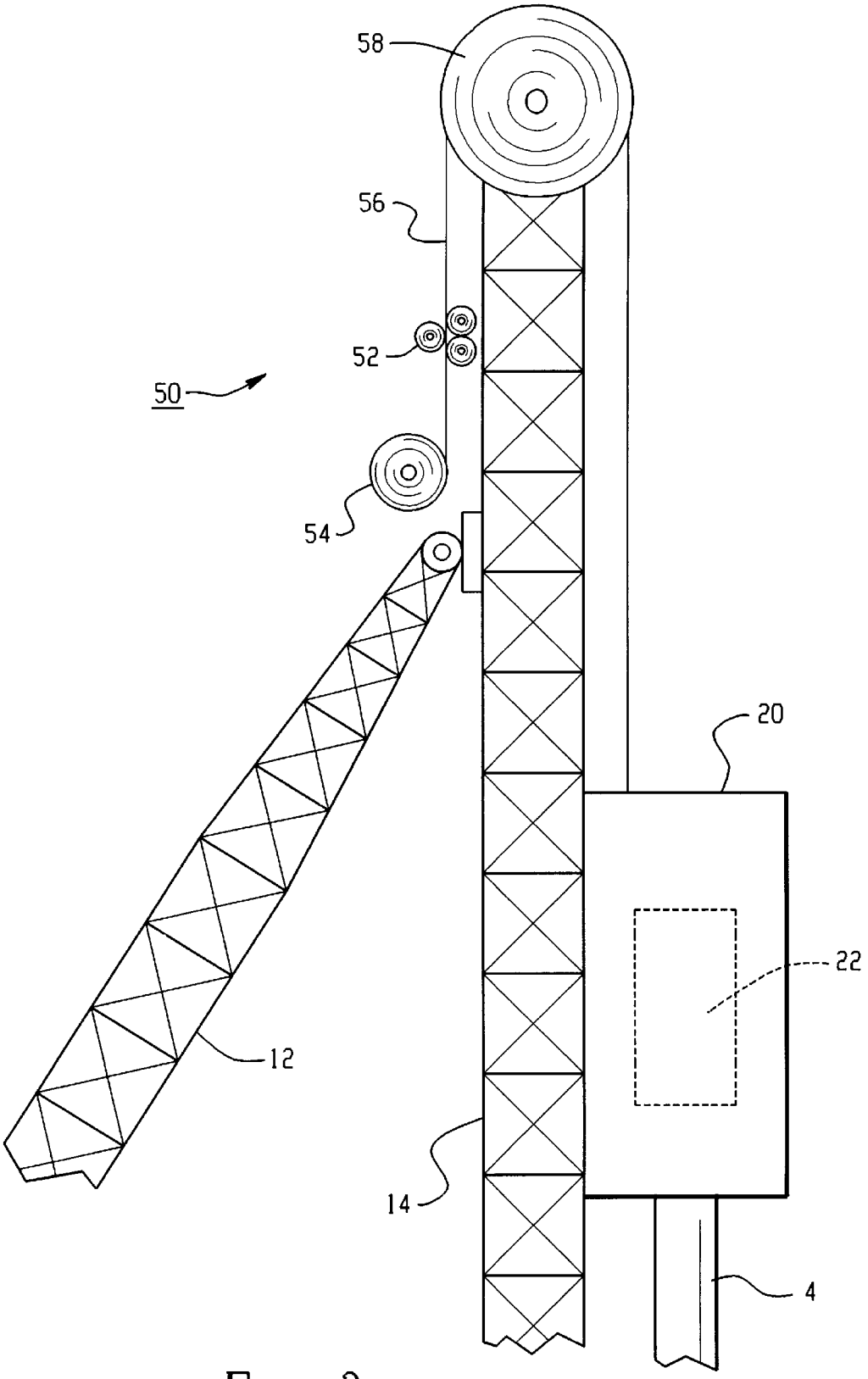
FIG. 3 is a perspective view of an alternative embodiment of a depth monitor.

In an alternative embodiment of the present invention, depth monitor 140 takes the form of an encoder wheel system 50, as shown in FIG. 3. Encoder wheel system 50 is generally comprised of an encoder wheel 52, a line reel 54, a line 56 and a pulley 58. Line 56 is mounted to line reel 54 and attached to hammer assembly 20, which rests on top of pile 4 during pile installation. Line 56 extends past encoder wheel 52 and over pulley 58. It should be appreciated that pulley 58 is provided in addition to pulleys 18. Line reel 54 provides tension to line 56. Initially, hammer assembly 20 is moved downward to rest on top of pile 4. This is the start position for encoder wheel 52. As pile 4 is driven into the ground by ram 22, line 56 will extend from line reel 54, due to hammer assembly 20 moving downward along with pile 4. As a result, encoder wheel 52 will rotate, thus generating digital pulses. The number of pulses counted as line 56 is extended is indicative of the depth of pile 4. The pulses are counted by a counter or microprocessor, and a value indicative of the total pulse count, incremental pulse count, or actual depth is sent to control unit 100. It should be appreciated that encoder wheel 52 may alternatively be mounted to the top of leads 14 adjacent to pulley 58, or even attached to pulley 58.

Depth monitor 140 may also use other suitable means for determining depth, including linear position sensing devices (i.e., proximity sensors) located on leads 14, ultrasonic 5 sound waves, laser beams, optics, and potentiometers.

Accelerometer 150 obtains a measure of pile rebound, temporary compression of the pile, and final displacement of the pile. Accelerometer 150 preferably takes the form of a transducer that generates an output voltage which is proportional to the acceleration of pile 4. As is well known, integration of acceleration provides a measurement of velocity, while double integration of acceleration provides a measurement of displacement. In the case of steel or timber piles, accelerometer 150 is suitably mounted to a helmet or drive cap 8, which is arranged on the top of pile 4 (FIG. 1). In this respect, a cushion (e.g., plywood) is arranged between drive cap 8 and pile 4 in the case of concrete piles. This will result in distortions to the measurement of temporary pile compression. In the case of concrete piles, accelerometer 150 is suitably mounted to drive cap 8 where only final displacement is needed, or suitably mounted directly onto pile 4, where temporary pile compression is needed.

Angle analyzer 160 measures the angle of leads 14, and therefore the angle of pile 4, since pile 4 is aligned parallel to leads 14. Angle analyzer 160 may operate either as a stand alone system or send information to control unit 100. Angle analyzer 160 is mounted to leads 14 (FIG. 1).

It should be appreciated that accelerometer 150 and angle analyzer 160 are optional sensing devices for recording system 2A. Other sensing devices may include a device for recording decibels (e.g., a microphone), and a global position sensor for use in conjunction with the Global Position System (GPS) to determine the position of the pile.

Figure 4:
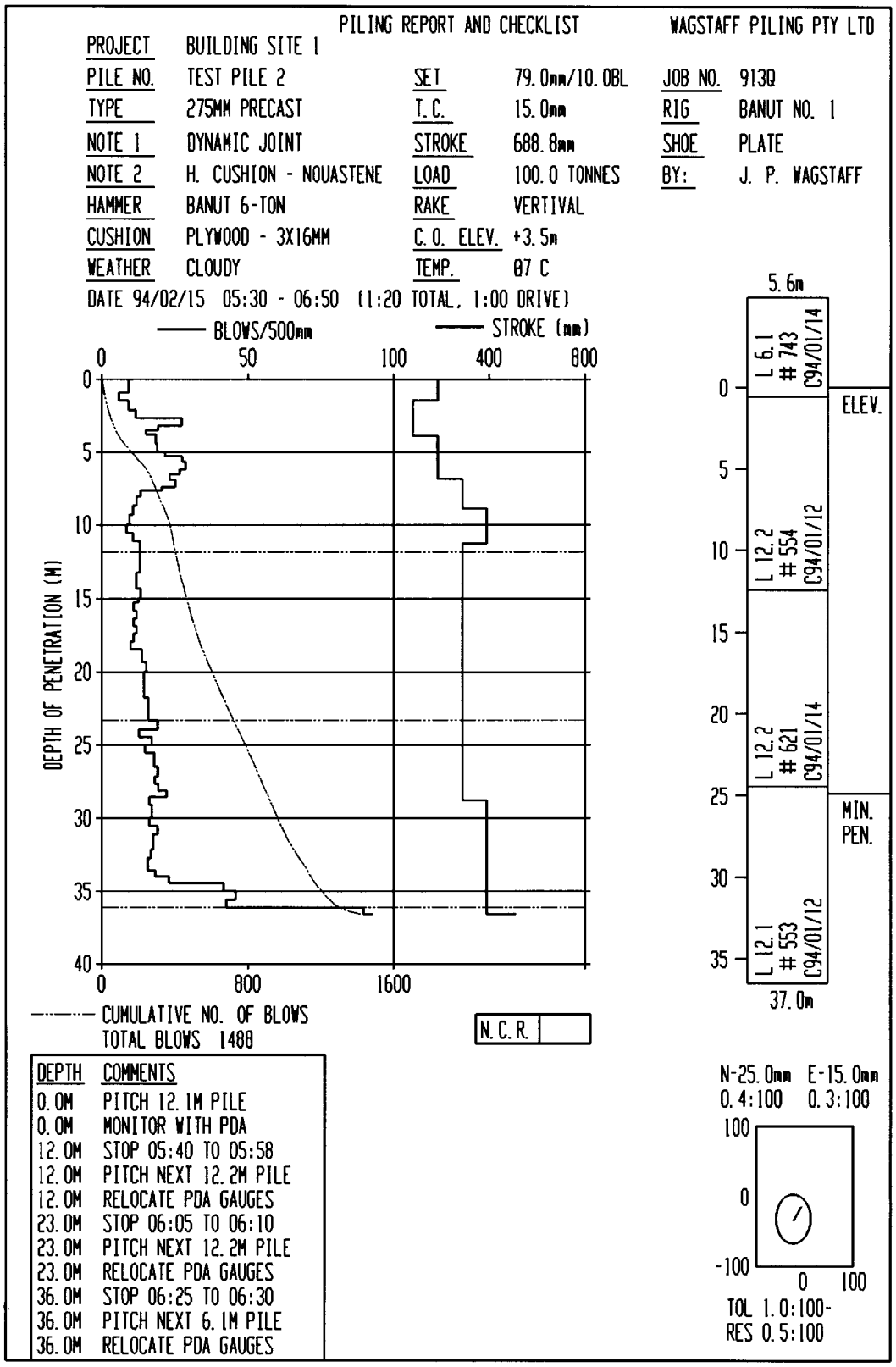
Fig. 4 (PRIOR ART)
FIG. 4 is an exemplary pile data summary report for a driven pile installation.

As indicated above, data collected by control unit 100 from the sensing devices (i.e., all of the data generated for each blow, as well as the chronological depth of penetration for the pile) is stored in data storage unit 108. This allows for convenient error checking, and maximum flexibility during processing of the collected data (i.e., generating a variety of different types of reports). Since data storage unit 108 is preferably removable from control unit 100, the data stored therein is conveniently transferrable to a remote PC for final automated processing of the results and productivity analysis. In this respect, a PC program (e.g., a spreadsheet, database, and/or report generation program) can provide a variety of detailed result summaries for each pile for the purpose of conducting productivity analysis. Reports generated using the collected data can be fully customized by the user. In this regard, report contents, report formats and language translations may be user selectable. In addition, collected data can be sorted by various criteria, including pile name, project and/or time of installation. Moreover, it should be noted that data common to multiple piles (e.g., surface elevation, pile load, etc.) can be entered directly into the PC, thus eliminating the need to have an operator enter the data into control unit 100. In addition, penetration increments for a report can be user adjusted on the PC, since penetration corresponding to each blow is recorded. FIG. 4 illustrates an exemplary report sheet for a driven pile. This report sheet allows for convenient assessment of the quality of the pile installation. For instance, blow count can be compared with the kinetic energy of the ram to evaluate hammer performance. It should be appreciated that the data can be displayed in either graphical or numerical form.

Figure 5:
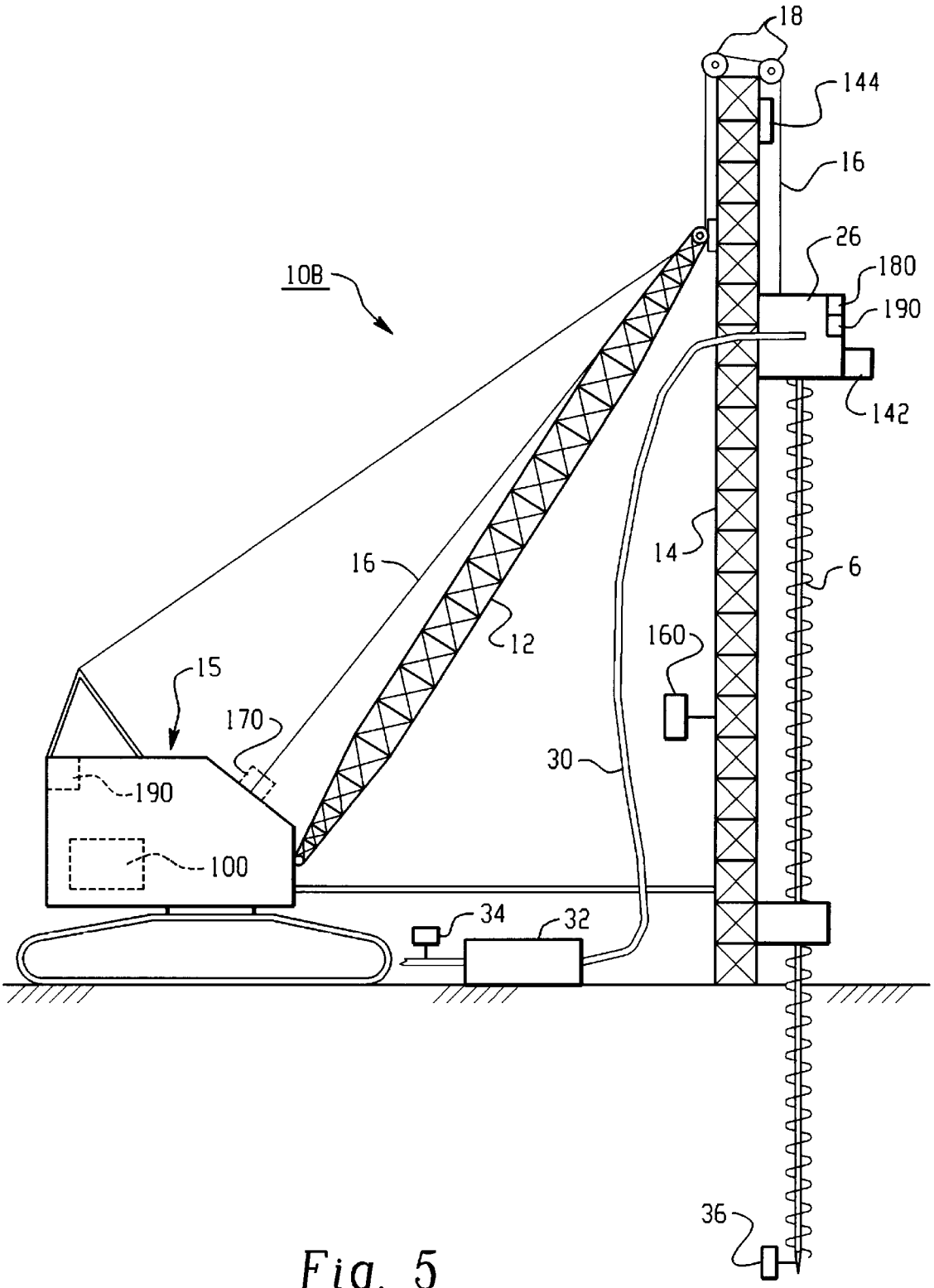
FIG. 5 is a perspective view of a continuous flight auger (CFA) rig equipped with a pile installation recording system.

Referring now to FIG. 5, there is shown a continuous flight auger (CFA) rig 10B. Those elements which are the same as pile driving rig 10A have been labeled with the same reference element numbers. Rig 10B includes a rotatable auger 6, which is mounted to leads 14 and powered by a hydraulic drive 26. Auger 6 has a hollow shaft for receiving grout (i.e., a fluid cement mixture). Grout is provided to auger 6 through a grout line 30.

Figure 6:
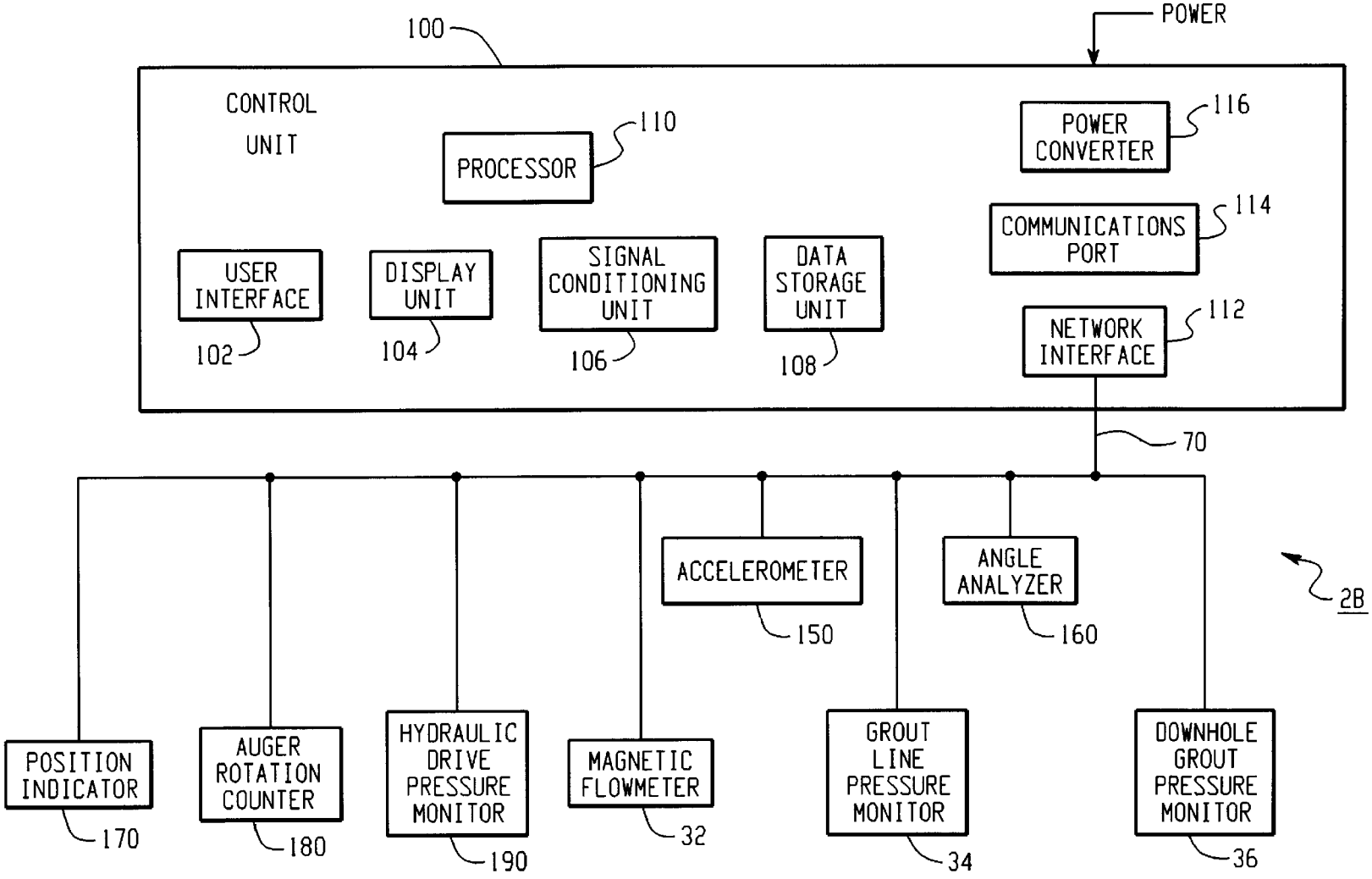
FIG. 6 is a block diagram of a pile installation recording system as configured for monitoring the installation of auger cast piles.

Recording system 2B as configured for CFA rig 10B is shown in FIG. 6. Recording system 2B includes some additional sensing devices not needed for driving rig 10A. In this respect, the sensing devices include a magnetic flowmeter 32, a grout line pressure monitor 34, a downhole grout pressure monitor 36, a position indicator 170, an auger rotation counter 180 and a hydraulic drive pressure monitor 190. Magnetic flowmeter 32 measures the volume of grout flowing into grout line 30. Grout line pressure monitor unit 34 is provided to measure the pressure in grout line 30, while downhole grout pressure monitor 36 is provided to measure the pressure of the grout at the downhole of auger 6 (i.e., the distal end of auger 6). Downhole grout pressure monitor 36 is comprised of a pressure transducer, which is encapsulated in a waterproof housing. The housing is attached to a cable and suspended down the hollow shaft of auger 6. The pressure transducer is positioned just above the bottom opening of auger 6. It should be appreciated that lack of a positive pressure indicates a partial vacuum, which could lead to a failure in the auger cast pile. It should also be noted that the pressure at any point can be calculated from the pressure at the inlet to grout line 30 and the pressure at the downhole of auger 6.

Position indicator 170 functions in a manner similar to depth monitor 140. In this respect, it determines the depth of the bottom of auger 6 as it penetrates the ground during drilling and is removed during grouting. Position indicator 170 is preferably located near cab 15, and is preferably powered by control unit 100 which gets power from rig 10B. In a preferred embodiment of the present invention position indicator 170 takes the form of an encoder wheel system, similar to the system shown in FIG. 3. In this regard, position indicator 170 is comprised of an encoder wheel mounted at a position along cable 16 (preferably near cab 15). As cable 16 is respectively extended and retracted by lowering and raising auger 6, the encoder wheel rotates, thus generating digital pulses. These pulses are counted by control unit 100. The total pulse count is indicative of the depth of auger 6. Other suitable means for position indicator 170 include a micro impulse radar (MR) system having a transmitter 142 and receiver 144 (FIG. 5), linear position sensing devices (i.e., proximity sensors) located on leads 14, ultrasonic sound waves, laser beams, optics, and potentiometers.

Auger rotation counter 180 counts the number of rotations of auger 6 to provide an auger rotation speed. Hydraulic drive pressure monitor 190 measures the amount of hydraulic pressure used to drive auger 6, and therefore the torque supplied to auger 6. It should be appreciated that while it is desirable to operate auger 6 at a maximum torque, if auger 6 develops too much torque, rig 10B will stall and thus cause project delays. Knowing the torque or pressure allows the rig to be operated at maximum efficiency. Hydraulic drive pressure monitor 190 preferably takes the form of a pressure transducer located at a hydraulic power supply attached to cab 15, or located at hydraulic drive 26.

The sensing devices also include angle analyzer 160. As indicated above, angle analyzer 160 provides the angle of leads 14. Accordingly, the angle at which auger 6 is directed into the ground can be determined.

It should be noted that angle analyzer 160, auger rotation counter 180, hydraulic drive pressure monitor 190, magnetic flowmeter 32, downhole grout pressure monitor 36, transmitter 142 and receiver 144 are optional sensing devices. Other sensing devices may include a temperature sensor for determining the temperature of the concrete, a humidity sensor and a GPS sensing device.

Control unit 100 receives data from each of the sensing devices. Accordingly, control unit 100 makes grout volume measurements using the volume data provided by magnetic flowmeter 32. Alternatively, control unit 100 may obtain volume measurement from a pump stroke count as obtained from grout line pressure monitor 34. However, for small diameter shafts the resolution per unit depth is not very precise if an individual pump stroke has a relatively large volume. Using the volume data, control unit 100 can store an moreover, control versus depth. Moreover, control unit 100 can compute the shaft size from the volume and depth data. Control unit 100 provides results which include concrete volume with depth, grout pressure, torque, time from start, and angle and installation, which are automatically obtained, and output to a report.

Display unit 104 may graphically display the cross-section of auger 6 as it is withdrawn, with a clear reference to the nominal volume per unit depth. Accordingly an operator may observe the volume ratio, and withdraw the auger 6 so that the minimum volume per unit depth is maintained yet fast enough that the volume ratio is not wasteful and therefore uneconomic. If a cross-section reduction is observed, the operator can lower auger 6 down into the hole a second time, if necessary. If a volume deficiency is observed, the operator can slow the withdrawal rate of auger 6.

It should also be appreciated that a touch screen display unit 104 allows the operator to easily input data such as job information, instrument calibration, and operating mode. In addition, brief information descriptions about the project, site, crew, pile, etc. may also be input. Therefore, control unit 100 can be operated easily by non-technical staff, such as a rig operator.

Figure 7:
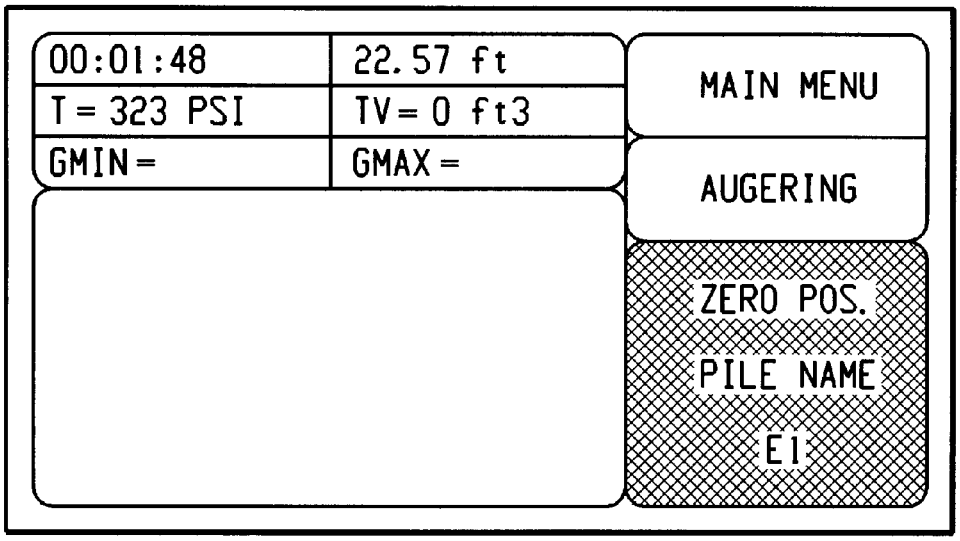
FIG. 7 is an exemplary augering display screen.

FIG. 7 provides an exemplary illustration of a screen display provided to the operator during an augering phase. The screen display includes the time of installation, the current position (depth) of the auger, the torque (T) on the auger, and the total volume (TV) of concrete installed.

Figure 8:
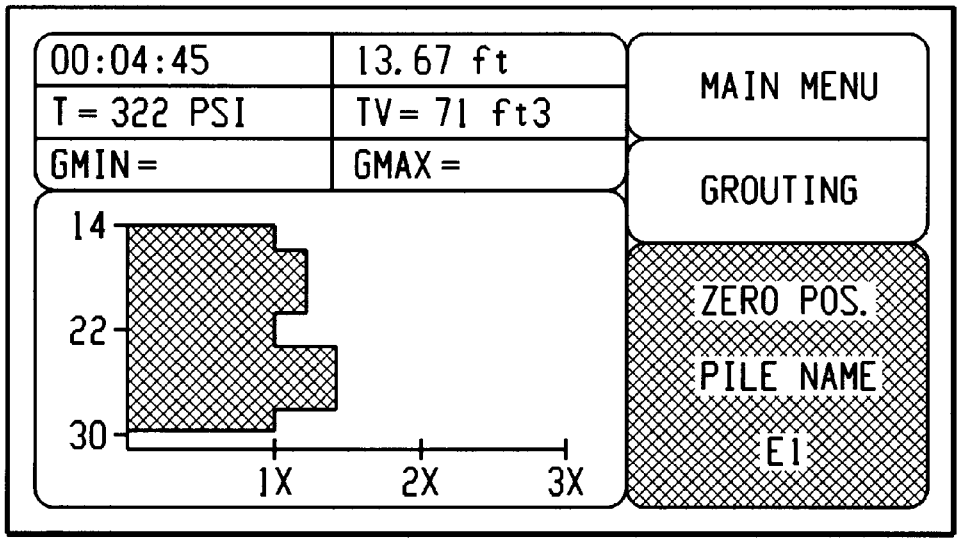
FIG. 8 is an exemplary grouting phase display screen.

FIG. 8 provides an exemplary illustration of a screen display provided to the operator during a grouting phase. The screen display includes the time of installation, the current position (depth) of the auger, the torque (T) on the auger, and the total volume (TV) of the concrete installed. The screen display also provides a graph showing the depth of the pile versus the volume of concrete installed, on a scale indicating a theoretical volume of concrete for a given depth. In this regard, the screen display provides a ratio of (1) the volume of concrete that has been actually pumped for a segment of the pile to (2) the volume of concrete that is theoretically expected for the segment of the pile ("1x" is a ratio of 1.0).

Figure 9:
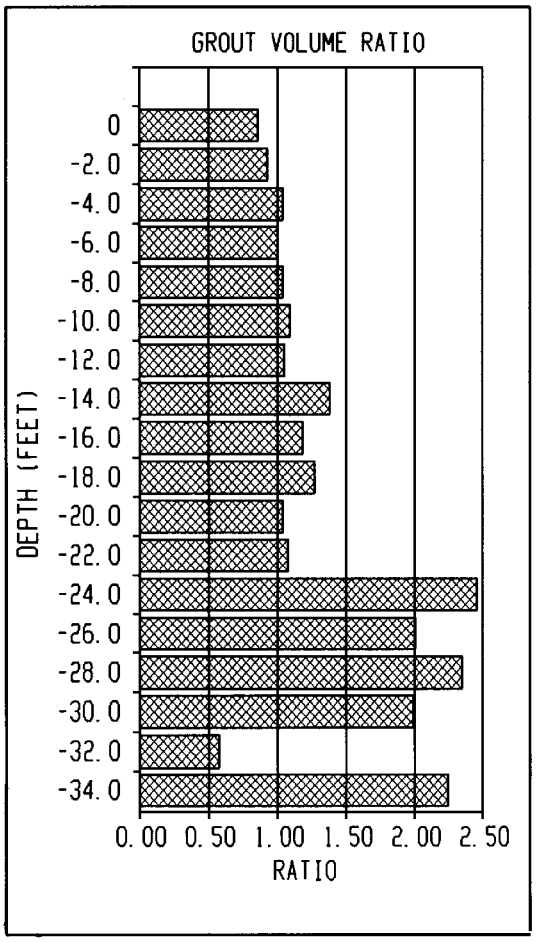
FIG. 9 is an exemplary pile data summary report for an auger cast pile installation.
Figure 9:
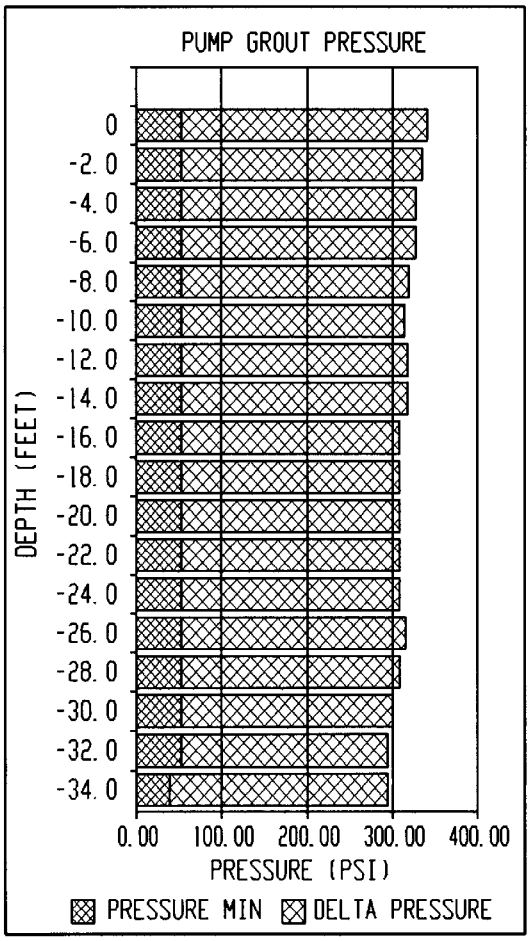
Figure 10:
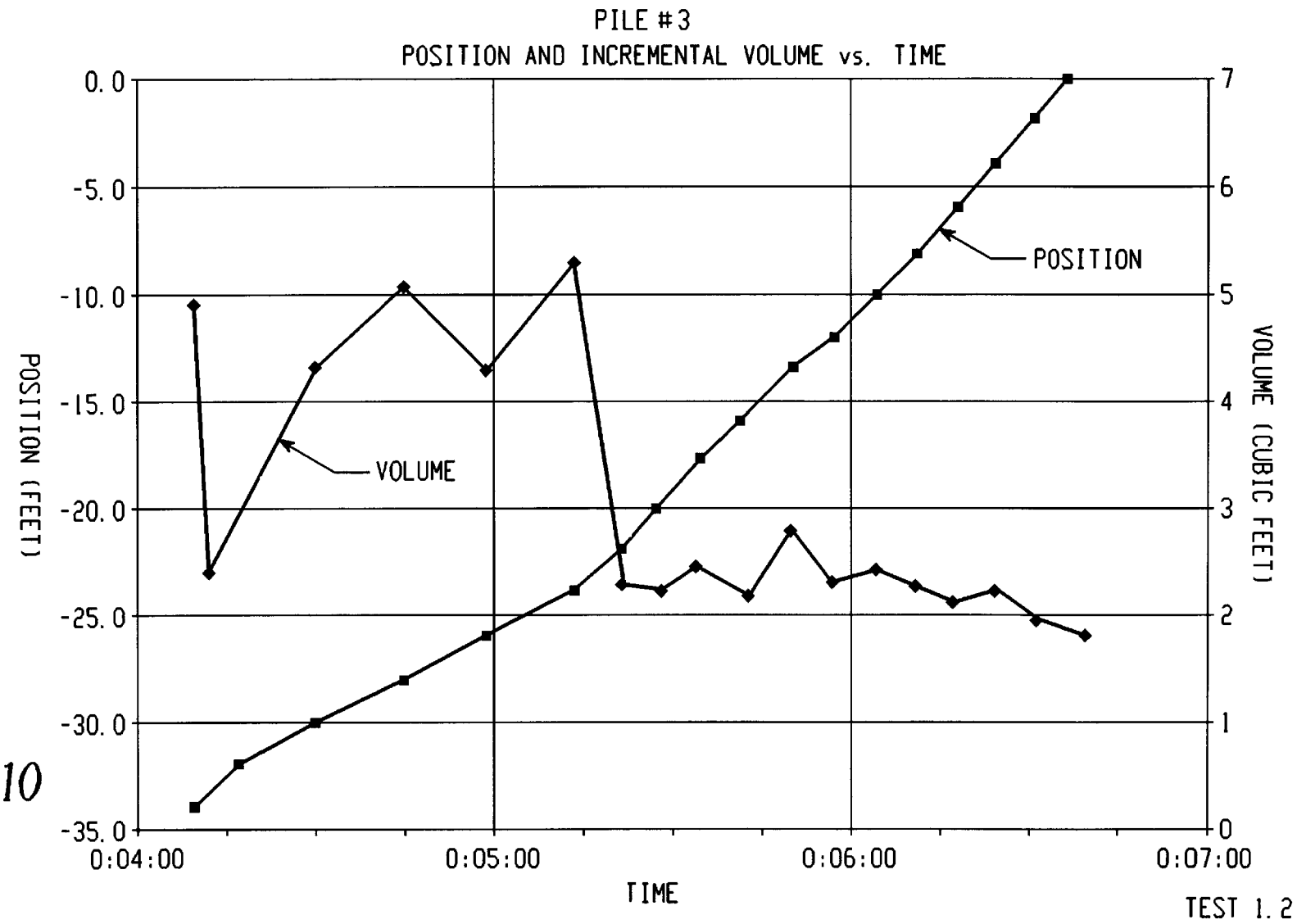
FIG. 10 is a graph of position and incremental volume versus time.

FIGS. 9 and 10 provide an exemplary pile data summary report including graphical displays of the grout volume ratio, pump grout pressure, and position and incremental volume versus time. It should be appreciated that the data can be displayed either graphically or numerically.

The present invention also finds utility with regard to drilled shafts. A drilled shaft is basically formed by: (a) drilling a hole, (b) filling the hole with slurry (e.g., bentonite and water) as it is drilled, (c) removing the drill from the hole, and (d) pumping concrete from the bottom of the hole (e.g., by using a tremie pipe) to fill the hole. Much of the information sensed by the present invention is applicable to drilled shafts. For instance, the depth of the concrete in the drilled shaft can be measured by using the depth monitor or the position indicator of the present invention. For example, a sonic pulse transmitter/receiver device or encoder wheel system could be used as a concrete level sensing device. In this regard, either the transmitter or receiver could be arranged to float on top of the concrete being pumped into the hole.

The foregoing description is a specific embodiment of the present invention. It should be appreciated that this embodiment is described for purposes of illustration only and that numerous alterations and modifications may be practiced by those skilled in the art without departing from the spirit and scope of the invention. For instance, some or all of the sensing devices may be directly connected via a cable to control unit 100, instead of the network and wireless communication configurations. It is intended that all such modifications and alterations be included insofar as they come within the scope of the invention as claimed or the equivalents thereof.

Having thus described the invention, it is now claimed:

1. A pile installation recording system for monitoring the installation of a pile into the ground, the system comprising:

control means including:

input means adapted for receiving installation data from at least one associated sensing means;

processing means for processing received installation data to form processed installation data;

data storage means for storing at least one of said received installation data and said processed installation data; and display means for displaying at least one of said received installation data and said processed installation data.

2. A pile installation recording system according to claim 1, wherein said sensing means include hammer monitor means for monitoring the velocity of a ram for driving the pile into the ground.

3. A pile installation recording system according to claim 2, wherein said hammer monitor means determines the kinetic energy of the ram.

4. A pile installation recording system according to claim 1, wherein said sensing means includes blow detection means for detecting the occurrence of a blow to a pile by a ram.

5. A pile installation recording system according to claim 4, wherein said blow detection means determines a hammer blow rate.

6. A pile installation recording system according to claim 1, wherein said sensing means includes depth monitoring means for determining the depth of the pile in the ground.

7. A pile installation recording system according to claim 6, wherein said depth monitoring means is comprised of:

transmitter means for transmitting a signal from a fixed position relative to a hammer means for driving the pile into the ground; and receiving means located at a fixed position relative to the ground for receiving the signal.

8. A pile installation recording system according to claim 6, wherein said depth monitoring means is comprised of:

transmitter means for transmitting a signal from a fixed position relative to the ground; and receiving means for receiving the signal and located at a fixed position relative to a hammer means for driving the pile into the ground.

9. A pile installation recording system according to claim 6, wherein said depth monitoring means is comprised of:

cable means arranged under tension from a reel means to a hammer means located at a position fixed relative to the pile, said cable means extending from the reel means as said pile move downward; and rotatable wheel means for receiving said cable means and generating pulses as it rotates, said wheel means rotating as said cable means is extended.

10. A pile installation recording system according to claim 1, wherein said sensing means includes an accelerometer for determining the acceleration, velocity and displacement of the pile as function of time during a blow.

11. A pile installation recording system according to claim 1, wherein said sensing means includes an angle analyzing means for determining the angle of the pile.

12. A pile installation recording system according to claim 1, wherein said pile is an auger cast pile installed in the ground using auger means.

13. A pile installation recording system according to claim 12, wherein said sensing means includes means for monitoring the volume of grout conveyed to said auger means.

14. A pile installation recording system according to claim 12, wherein said sensing means includes pressure monitor means for determining the pressure of grout in a grout line means for conveying grout to said auger means.

15. A pile installation recording system according to claim 12, wherein said sensing means includes downhole pressure monitor means for determining the pressure of the grout at a remote position downhole of said auger means.

16. A pile installation recording system according to claim 15, wherein said downhole pressure monitoring means includes:

cable means extending through a hollow shaft of said auger means; and pressure transducer means encapsulated within a housing means and suspended from the cable means inside the hollow shaft at a location above the downhole.

17. A pile installation recording system according to claim 12, wherein said sensing means includes a position indicator means for determining the position of said auger means.

18. A pile installation recording system according to claim 17, wherein said position indicator means is comprised of:

transmitter means for transmitting a signal from a fixed position relative to said auger means; and receiving means located at a fixed position relative to the ground for receiving the signal.

19. A pile installation recording system according to claim 17, wherein said position indicator means is comprised of:

transmitter means for transmitting a signal from a fixed position relative to the ground; and receiving means for receiving the signal and located at a fixed position relative to said auger means.

20. A pile installation recording system according to claim 17, wherein said position indicator means is comprised of:

cable means arranged under tension from a reel means to said auger means, said cable means extending from the reel means as said auger means is moves into the ground, and said cable means retracting onto the reel means as said auger means is withdrawn from the ground; and rotatable wheel means for receiving said cable means and generating pulses as it rotates, said wheel means rotating as said cable means is extended and retracted.

21. A pile installation recording system according to claim 12, wherein said sensing means includes counting means for counting rotations of said auger means.

22. A pile installation recording system according to claim 12, wherein said sensing means includes pressure monitor means for determining torque supplied to said auger means by auger drive means.

23. A pile installation recording system according to claim 1, wherein said data storage means is removable from said control means.

24. A pile installation recording system according to claim 1, wherein said system further comprises a communications network means adapted for connecting said control means to said sensing means.

25. A pile installation recording system according to claim 24, wherein said control means is a master device on said communications network means and said sensing means are slave devices on said communications network means.

26. A pile installation recording system according to claim 1, wherein said system further comprises wireless communications means for communicating data between said control means and said sensing means.

27. A pile installation recording system according to claim 26, wherein said wireless communications means includes a plurality of wireless modems.

28. A pile installation recording system according to claim 1, wherein said pile is a cast pile installed in the ground using drill means.

29. A pile installation recording system for monitoring the installation of a pile into the ground, the system comprising:

control means including:

input means for receiving installation data from sensing means for sensing one or more installation parameters, processing means for processing the installation data, data storage means for storing the installation data, and display means for displaying the installation data; and communications network means for connecting said control means to said sensing means.

30. A pile installation recording system according to claim 24, wherein said control means is a master device on said communications network means and said sensing means are slave devices on said communications network means.

31. A pile installation recording system for monitoring the installation of a pile into the ground, the system comprising:

sensing means adapted for sensing one or more installation parameters and generating installation data therefrom;

control means including:

input means for receiving said installation data from said sensing means, processing means for processing received installation data to form processed installation data, data storage means for storing at least one of said installation data and said processed installation data, and display means for displaying at least one of said installation data and said processed installation data; and wireless communications means adapted for communicating data between said control means and said sensing means.

32. A pile installation recording system according to claim 30, wherein said wireless communications means includes a plurality of wireless modems.

* * * * *